US005224760A

United States Patent [19]

Gibbs

[11] Patent Number: 5,224,760

[45] Date of Patent: Jul. 6, 1993

[54] DETACHABLE LAWN CHAIR

[75] Inventor: Terence E. Gibbs, Grandview, N.Y.

[73] Assignee: Shin Yeh Enterprise Co., Ltd., Taiwan

[21] Appl. No.: 817,604

[22] Filed: Jan. 7, 1992

[51] Int. Cl.[5] ..... A47C 7/00

[52] U.S. Cl. ..... 297/446; 297/441; 297/325

[58] Field of Search ..... 297/440, 441, 442, 443, 297/444, 445, 446, 447, 448

[56] References Cited

U.S. PATENT DOCUMENTS 2,428,190 9/1947 Akse ..... 297/444
4,234,226 11/1980 Colby ..... 297/441 X

FOREIGN PATENT DOCUMENTS 241628 10/1987 European Pat. Off. ..... 297/440
2434104 8/1973 Fed. Rep. of Germany ..... 297/325
809549 2/1959 United Kingdom ..... 297/325

*Primary Examiner*—Laurie K. Cranmer
*Attorney, Agent, or Firm*—Ladas & Parry

[57] ABSTRACT

The chair includes a first inverted U-shaped frame which has two arms defining a back portion and two extensions respectively extending from the two arms to define a seat portion. The two arms have a pair of tabs each with a notch. A first connecting rod is attached to the free ends of the two extensions. Two spaced second U-shaped frames each include a front leg and a rear leg with a threaded bolt provided at the topmost portion thereof. The first connecting rod is mortised to the front legs while a second connecting rod is mortised to the rear legs below the threaded bolt when the chair is assembled. At that configuration, the notch of the tab rests on the threaded bolt.

5 Claims, 7 Drawing Sheets

DETACHABLE LAWN CHAIR

BACKGROUND OF THE INVENTION

1. FIELD OF INVENTION

This invention relates to a lawn chair, more particularly to a lawn chair which is easily detachable so that it occupies a minimum of storage space.

2. DESCRIPTION OF THE RELATED ART

Lawn chairs are meant for sitting outdoors, such as in the yard of a house or outside while on a leisure trip. To fit the situation demands of each situation, a lawn chair should be easily detachable so that it can be taken out when needed and stored away when not in need.

FIG. 1 shows a lawn chair (A) of the prior art. As shown, the seat portion, the back portion, the arm supports and the leg supports are pivotally connected so that the chair can be folded if needed. Although this lawn chair can be opened to form a seat and can be stored easily, it cannot provide stability when a person is seated thereon.

FIG. 2 shows another lawn chair of the prior art. It is made up of three frames (A1,A2,A3) which are welded one to another to form a chair. A long strap (A4) is provided across the frames (A2,A3) to form the seat portion and the back portion, thus forming a lawn chair. Although this kind of lawn chair can provide stability for a person seated thereon it has the following drawbacks.

(1) After the chair is made, a large car is required to transport the chair to-the desired place since it cannot be folded. To hire a large car increases the cost of transportation.

(2) Since the chair is not detachable, it is not easy to store the same. A furniture dealer thus he needs a large storage for the chairs, causing him or her inconvenience.

SUMMARY OF THE INVENTION

A primary object of the present invention is to provide a lawn chair which is free from the above-mentioned drawbacks and which is detachable so that it can be easily stored and transported to a desired place.

According to the present invention, the lawn chair includes a first inverted U-shaped frame which has two arms with a first engaging unit, a back portion defined between the two arms and a seat portion defined between two extensions which extend from the two arms. A first connecting rod is welded to the free ends of the two extensions. Two spaced second inverted U-shaped frames each includes a front leg with a second engaging unit and a rear leg with a third and a fourth engaging unit. A second connecting rod is mortised to the rear legs and the first connecting rod is mortised to the front legs of the two second inverted U-shaped frames when the first inverted U-shaped frame is provided between the two inverted second U-shaped frames to form a lawn chair. In that situation, the first engaging unit engage the third engaging unit of the rear legs.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 1:
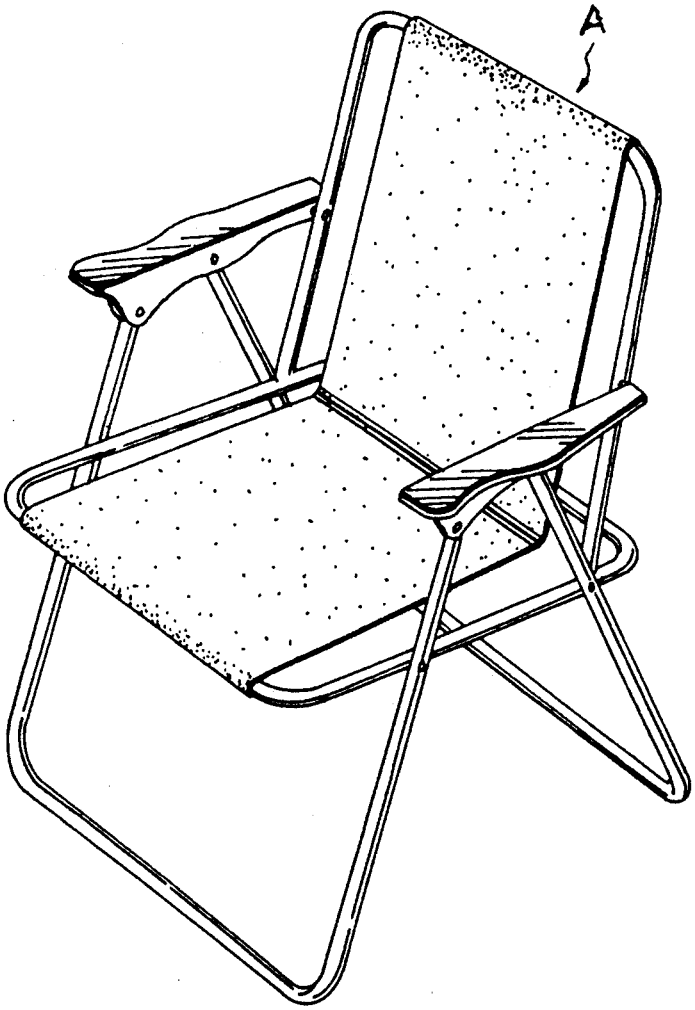
FIG. 1 PRIOR ART
FIG. 1 shows a lawn chair of the prior art.
Figure 2:
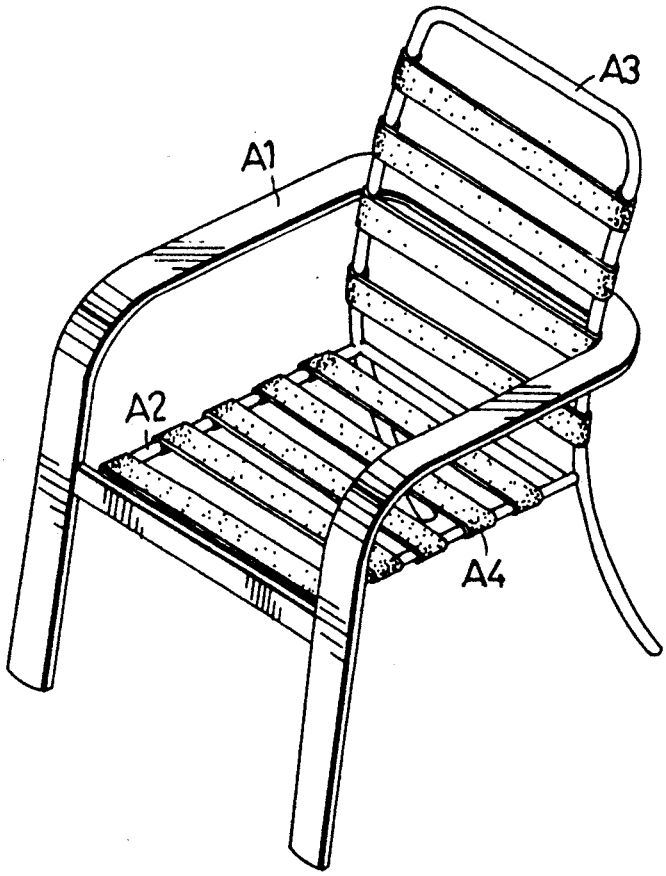
FIG. 2 PRIOR ART
FIG. 2 shows another lawn chair of the prior art.
Figure 3:
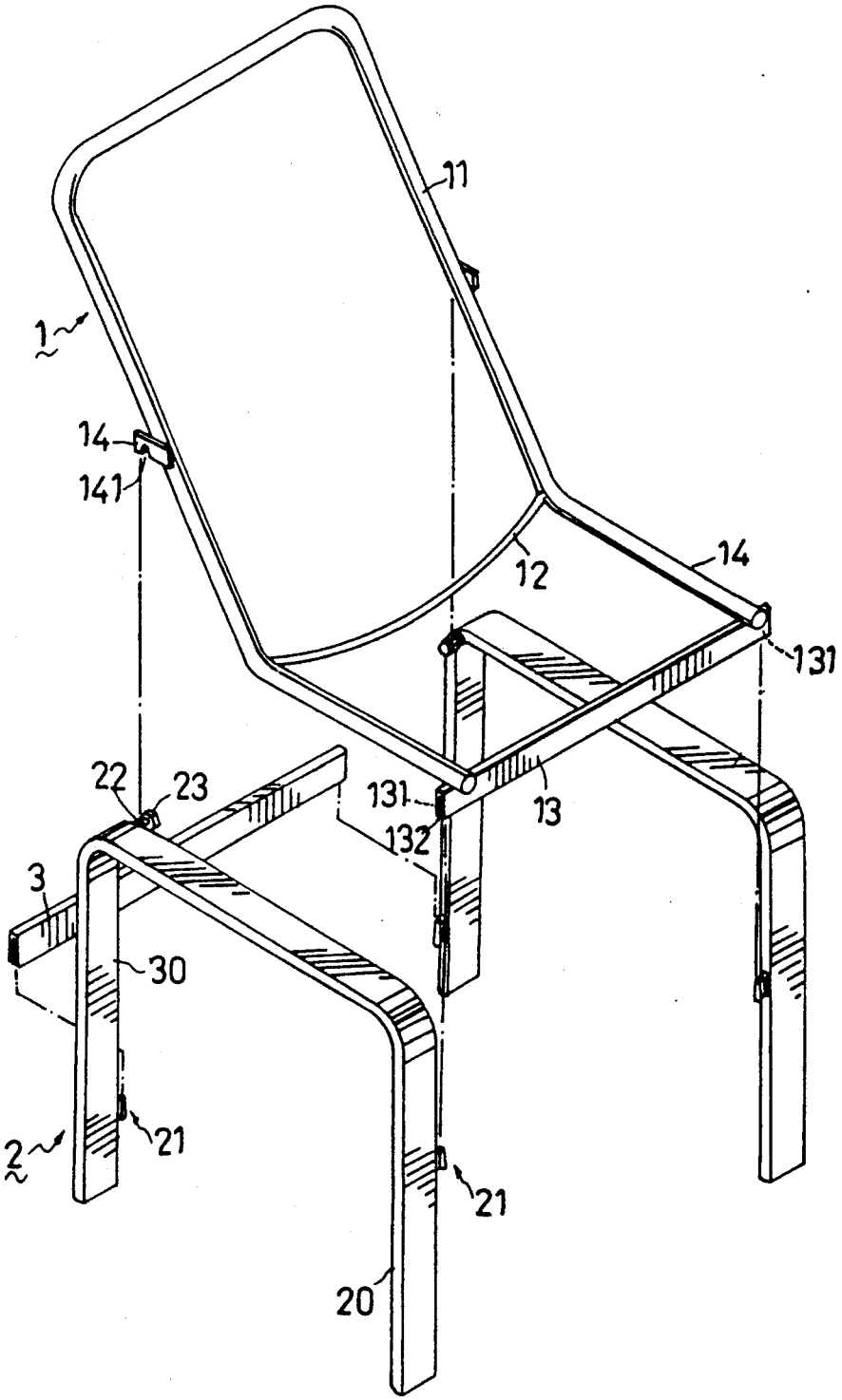
FIG. 3 shows an exploded view of a preferred embodiment of a lawn chair of the present invention.

Referring to FIG. 3, an exploded view of a lawn chair of the present invention is shown to comprise a first inverted U-shaped frame (1) including two arms (11) defining a back portion therebetween and two extensions (14) respectively extending from the two arms (11) to define a seat portion therebetween. To enforce the rigidity of the frame (1), an enforcing rod (12) is provided where the arm meets the extension, dividing the back portion from the seat portion. The two arms (11) include a pair of tabs (14), each of which has a first engaging unit (141). In this embodiment, a notch (141) is used as the first engaging unit (141). A first connecting rod (13) is fixed to the free ends of the two extensions (14).

Two spaced second inverted U-shaped frames (2) each include a front leg (20) with a second engaging unit (21) and a rear leg (30) with a third engaging unit (22) located higher than the second engaging unit (21). The rear leg (30) further has a fourth engaging unit (21) located below said engaging unit. The second and the fourth engaging units are designated by the same numeral (21) since they have the same structure in the preferred embodiments.

Figure 5:
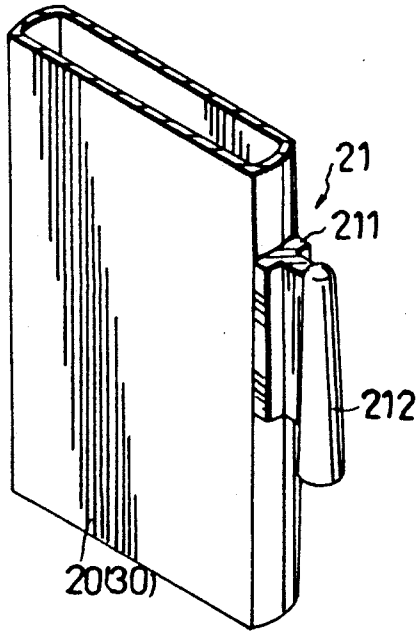
FIGS. 4 and 5 respectively show two engaging units employed in the preferred embodiment of the chair of the present invention.

An important aspect to note in the present invention is that the second and fourth engaging units (21) are tenons (212) which has a cross-section gradually decreasing upwards in dimension and which are integrally formed with a T-shaped plate (211). The T-shaped plate is secured fixedly to the legs, as shown in FIG. 5. The third engaging unit (22) is a threaded rod fixed to the topmost portion of the rear leg (30).

Figure 4:
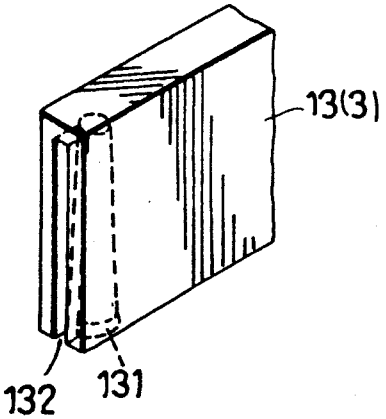

Another aspect to note is that the connecting rods (13,3) in the preferred embodiment have a pair of mortise means, including a truncated cone-shaped bore (131) of predetermined depth extending to a longitudinal top edge of the connecting rod and a notch (132) having access to the truncated, cone-shaped bore, as shown in FIG. 4. Since the truncated bore and the notch are formed on the free end of the connecting rod, the truncated, cone-shaped bore (131) can fit slidably onto the tenon (212) when the connecting rods are provided between the two spaced second inverted U-shaped frames (2).

After the lawn chair of the present invention is assembled, the notch (141) of the tab (14) is placed on the threaded rod (22). A threaded nut (23) can be threaded on the threaded rod so as to secure the first inverted frame to the legs.

Figure 6:
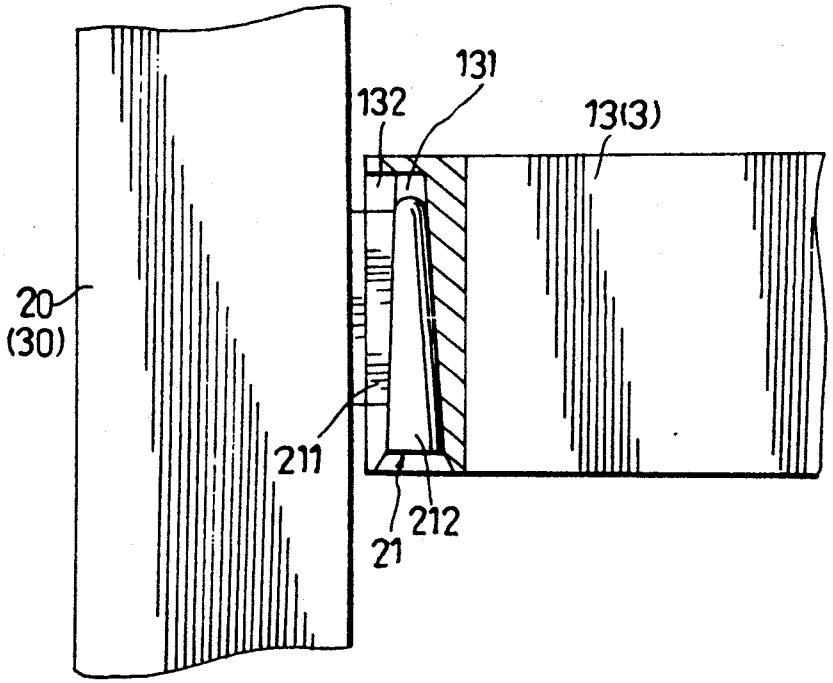
FIG. 6 shows an engaging configuration of the two engaging units of FIGS. 4 and 5.
Figure 7:
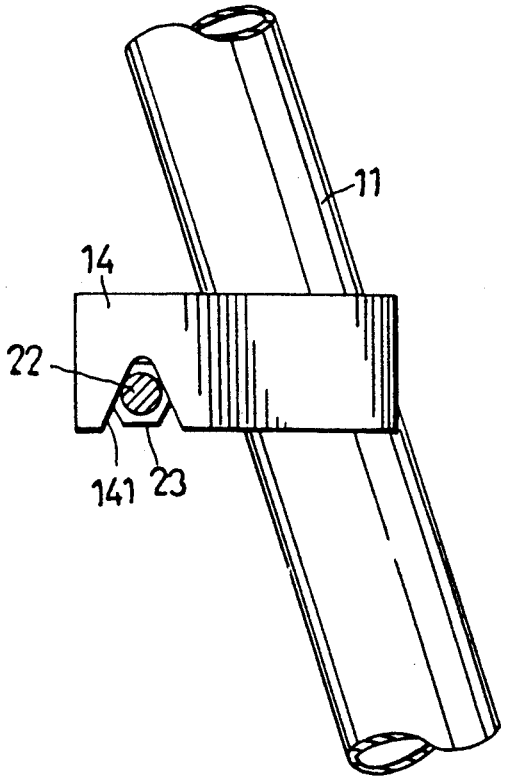
FIG. 7 shows another two engaging units employed in the preferred embodiment of the lawn chair of the present invention.
Figure 8:
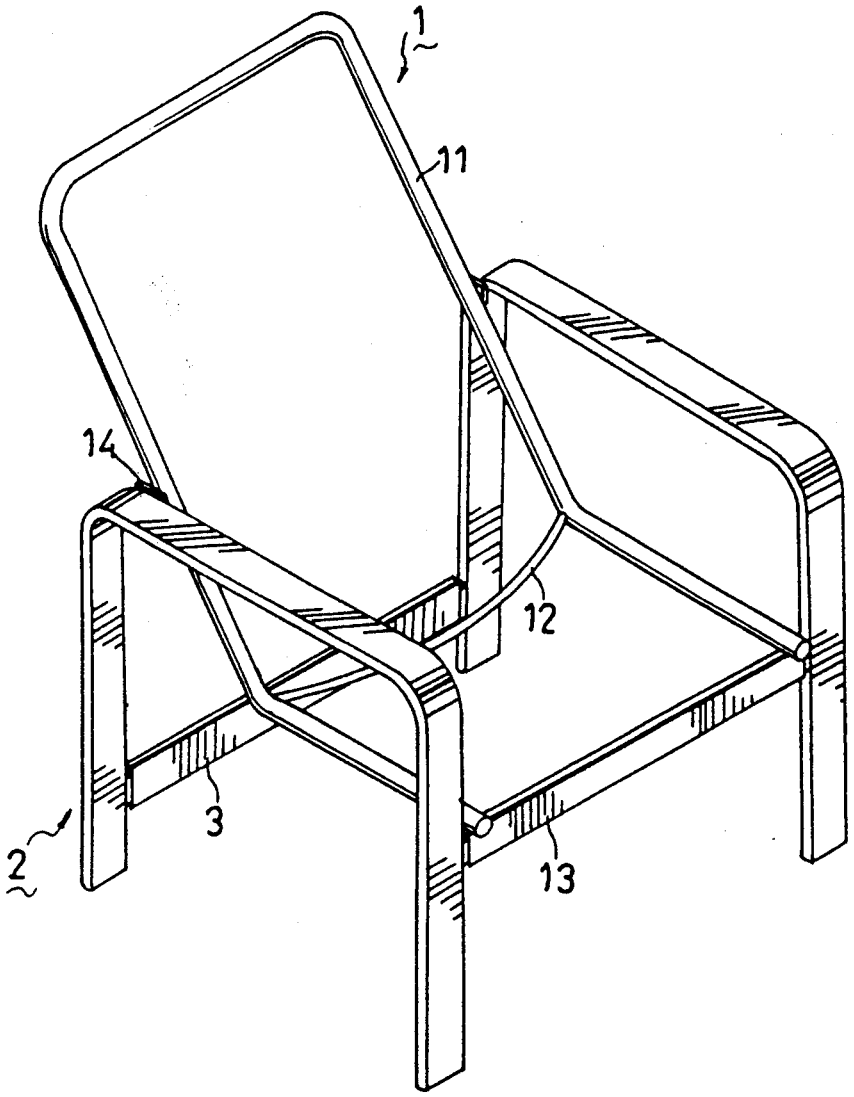
FIG. 8 shows a lawn chair of FIG. 3 after assembly.

Referring to FIG. 6, since a clearance remains at the topmost end of the tenon (212) after its insertion into the truncated, cone-shaped bore (131) of the connecting rod, the first inverted frame (1) can engage firmly, when a load is applied on the seat portion. The heavier the load is, the deeper the tenon (212) extends into the truncated, cone-shaped bore (131). Thus, the engaging system in this chair becomes firmer as the load gets heavier. A person seated in the chair of the present invention will feel more at ease and more secure than he or she would feel in the chairs of the prior art, a feature the prior art chair can hardly provide.

In case the chair needs to be disassembled in order to be stored, one can simply hammer the connecting rods (13,3) upwards, thereby disengaging the connecting rods from the tenons.

In short the chair of the present invention can provide the following advantages:

(1) Since the chair is easily detachable, only a small space is needed for storing a large number of such chairs. Only a small car will be required to move a large number of the chairs. A small car means a lower cost of transportation.

(2) The engaging system used in the present chair provides a feeling of stability and security for the person seated therein. The heavier the person is, the more stable the chair becomes.

(3) To store a large number of these chairs, only a small space is required, conveniencing a dealer of the same.

(4) Only a small amount of time will be needed to disassemble a large number of these chairs because they are easily disassembled. A small amount of time will be needed because the detaching is easy.

With the invention thus explained, it is obvious to those skilled in the art that several modifications and variations can be made without departing from the scope and spirit of the present invention. It is therefore intended that this invention be limited only in the appended claims.

I claim:

1. A detachable lawn chair comprising:

a first inverted U-shaped frame which has two arms defining a back portion therebetween and two extensions respectively extending from said two arms to define a seat portion therebetween wherein said extensions each have a free end.

a first connecting rod fixed to the free ends of said two extensions, said first connecting rod having a first end, a second end and a pair of first slot means formed respectively on said first and second end;

said two arms having a pair of tabs, each of which includes a first engaging unit;

two spaced second inverted U-shaped frames, each of which has a front leg with a second engaging unit adapted to fit slidably into said first slot means of said first connecting rod, and a rear leg with a third engaging unit located higher than said second engaging unit and detachably engageable with said first engaging unit of said tab when said back portion and said seat portion are provided between said two spaced second inverted U-shaped frames to form said lawn chair;

each of said rear legs further having a fourth engaging unit provided below said third engaging unit; and a second connecting rod having a first end, a second end, and formed respectively on said ends a pair of second slot means which slidably fit onto said fourth engaging unit of said rear legs when said second connecting rod is provided between said two rear legs of said two spaced second inverted U-shaped frames.

2. A detachable lawn chair as claimed in claim 1, wherein each of said first and second connecting rods includes a top horizontal edge and a bottom horizontal edge, each of said first and second slot means including a pair of mortise means which have a truncated cone-shaped bore of predetermined depth extending from said bottom horizontal edge into said top horizontal edge with a notch having an access to said truncated cone-shaped bore.

3. A detachable lawn chair as claimed in claim 1, wherein said second and fourth engaging units are tenons having a cross section area gradually decreasing upwards.

4. A detachable lawn chair as claimed in claim 1, wherein said first engaging unit is a notch.

5. A detachable lawn chair as claimed in claim 1, wherein said third engaging unit is a threaded bolt.

* * * * *